US005568860A

United States Patent [19]

Stringwell et al.

[11] Patent Number: 5,568,860

[45] Date of Patent: Oct. 29, 1996

[54] PIVOT POINT CONTACT WITH SCRUBBING ACTION SWITCH

[75] Inventors: Roderick W. Stringwell, Keokuk, Iowa; Gregory P. Van Vooren, Macomb, Ill.

[73] Assignee: Methode Electronics, Inc., Chicago, Ill.

[21] Appl. No.: 264,730

[22] Filed: Jun. 23, 1994

[51] Int. Cl.[6] ..... H01H 1/60

[52] U.S. Cl. ..... 200/242; 200/241; 200/547; 200/551

[58] Field of Search ..... 200/242, 241, 200/547, 549, 550, 551, 552, 553, 554, 557, 252, 253, 254, 255

[56] References Cited

U.S. PATENT DOCUMENTS

| | | | |
|---|---|---|---|
| 3,250,882 | 5/1966 | Campbell et al. | 200/241 |
| 3,319,022 | 5/1967 | Froyd et al. | 200/241 |
| 3,482,067 | 12/1969 | Sanford | 200/553 |
| 3,879,592 | 4/1975 | Comerford et al. | 200/241 |
| 4,070,555 | 1/1978 | Carli | 200/241 |

FOREIGN PATENT DOCUMENTS

| | | | |
|---|---|---|---|
| 2339242 | 8/1977 | France | H01H 1/18 |
| 1917411 | 6/1965 | Germany | H01H 1/18 |
| 1811854 | 8/1969 | Germany | H01H 1/36 |
| 1170422 | 11/1969 | United Kingdom | H03J 5/24 |

OTHER PUBLICATIONS

European Patent Office, Patent Abstracts of Japan, vol. 018 No. 595 (E-1630), 14 Nov. 1994: Abstract to Japanese Publication No. JP930019843, filed on Aug. 2 ,1993.

*Primary Examiner*—David J. Walczak
*Attorney, Agent, or Firm*—David L. Newman

[57] ABSTRACT

An electrical switch with pivot point wiping contact assemblies for scrubbing debris from electrical contact mating surfaces. For each electrical contact within the switch there is a battery rivet having a convex mating surface and a contact rivet which also has a convex mating surface. The contact rivet is mounted onto one end of a resilient wiping arm consisting of conductive material. The other end of the wiping arm is pivotally mounted within the slot of a pocket contact consisting of conductive material. Also connected to the wiping arm is a contact driver which abuts a manually moveable pin. Therefore, by moving the pin the resilient wiping arm rubs the contact rivet mating surface onto the battery rivet mating surface while making an electrical connection.

15 Claims, 5 Drawing Sheets

PIVOT POINT CONTACT WITH SCRUBBING ACTION SWITCH

BACKGROUND OF THE INVENTION

This invention pertains to an electrical switch, and in particular to an electrical switch with pivot point wiping contacts which provide for scrubbing action of electrical contact mating surfaces to prevent debris and other foreign matter from residing on the mating surfaces.

Electrical switches which utilize point contacts for making an electrical connection are widely used in the electronics industry. Normally, to make an electrical connection, the contact points come together by the vertical movement of either one or both contacts. However, any insulative films or other foreign matter present on the mating surfaces will prevent an electrical connection from being made. For instance, as the contacts come together, arcing may result which causes corrosion in the form of oxidized metal to develop on the contact mating surface areas. The oxidized metal acts as an insulator which, unless removed, will prevent the making of an electrical connection.

In view of the above, it is an object of the invention to remove debris and other foreign matter so that an electrical connection can be made.

SUMMARY OF THE INVENTION

In one form of the invention, an electrical switch utilizes pivot point wiping contact assemblies for scrubbing debris from electrical contact mating surfaces. To make an electrical connection, each electrical contact within the switch has a battery rivet having a convex mating surface and a contact rivet also having a convex mating surface. The contact rivet is mounted onto one end of a resilient wiping arm consisting of conductive material. The other end of the wiping arm is pivotally mounted within the slot of a pocket contact consisting of conductive material. Also connected to the wiping arm is a contract driver which abuts a manually moveable pin. Therefore, by moving the pin, the wiping arm rubs the contact rivet mating surface onto the battery rivet mating surface.

Various means for practicing the invention and other advantages and novel features thereof will be apparent from the following detailed description of an illustrative preferred embodiment of the invention.

BRIEF DESCRIPTION OF THE DRAWINGS

There is shown in the drawings a presently preferred embodiment of the present invention, wherein like numerals in the various figures pertain to like elements, and wherein.

DETAILED DESCRIPTION OF THE PRESENTLY PREFERRED EMBODIMENTS

Figure 1:
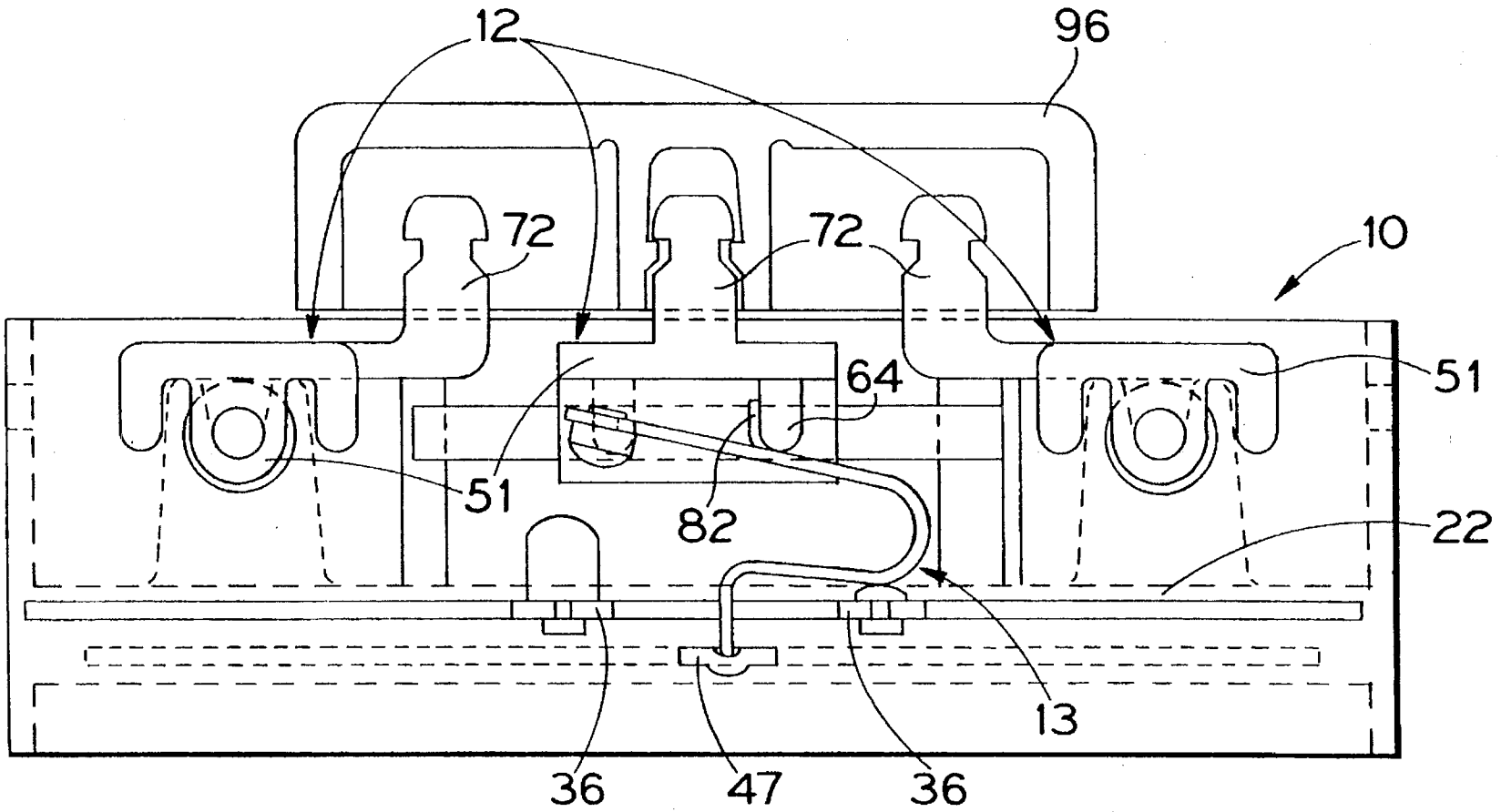
FIG. 1 is a cross-sectional side view of the switch assembly showing only one pivot point wiping contact which is in the open position.
Figure 2:
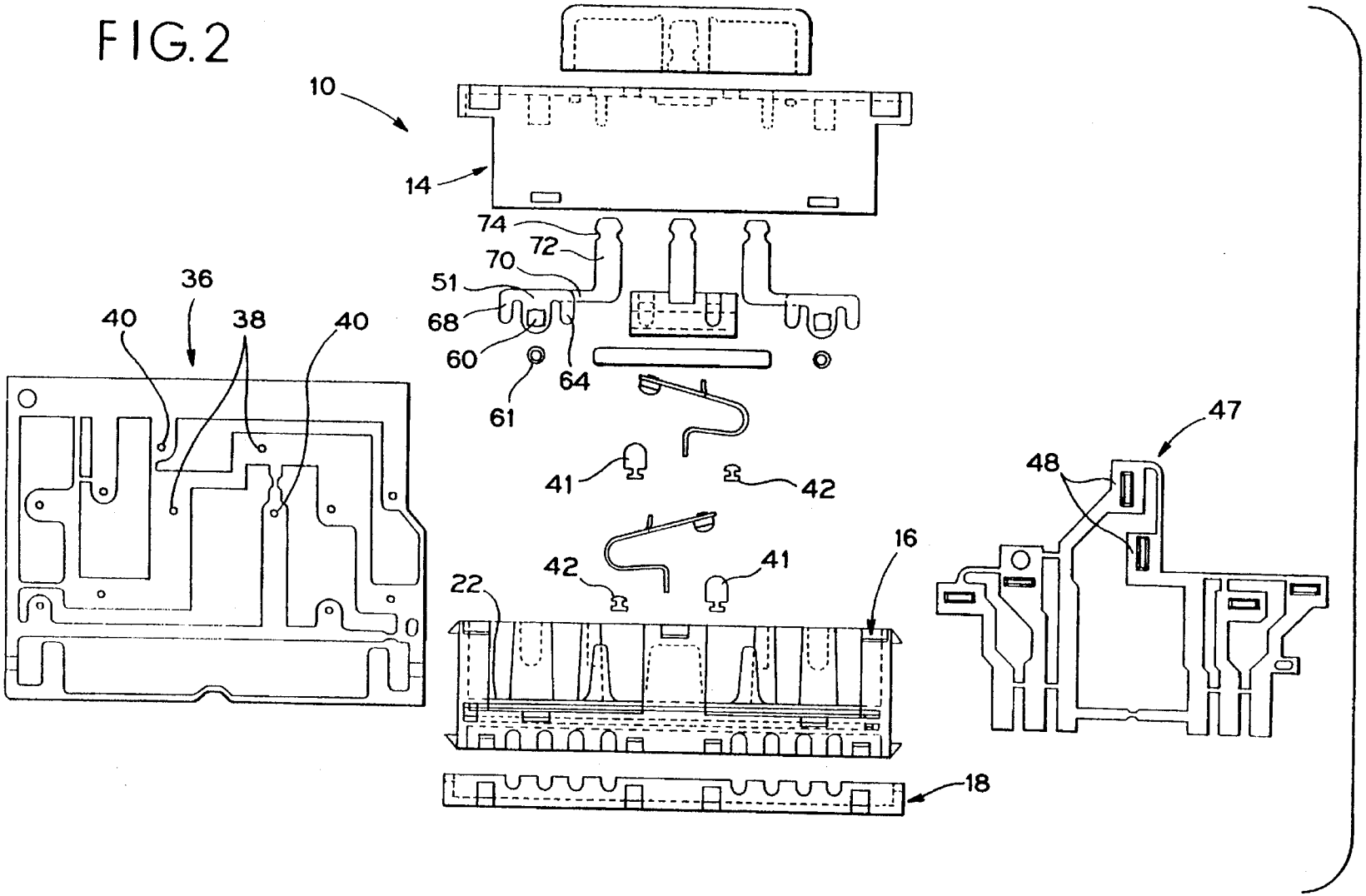
FIG. 2 is an exploded side view of the switch assembly with a corresponding top view of the signal insert and pocket insert.

Referring to the drawing, and particularly to FIG. 1, a seat control assembly 10 is shown having three identical contact assemblies 12 with each contact assembly manipulating two pivot point wiping contact assemblies (only one pivot point wiping contact assembly 13 is shown in FIG. 1). As shown in FIG. 2, the seat control assembly 10 has a top cover 14, a base 16, and a bottom cover 18.

Figure 3:
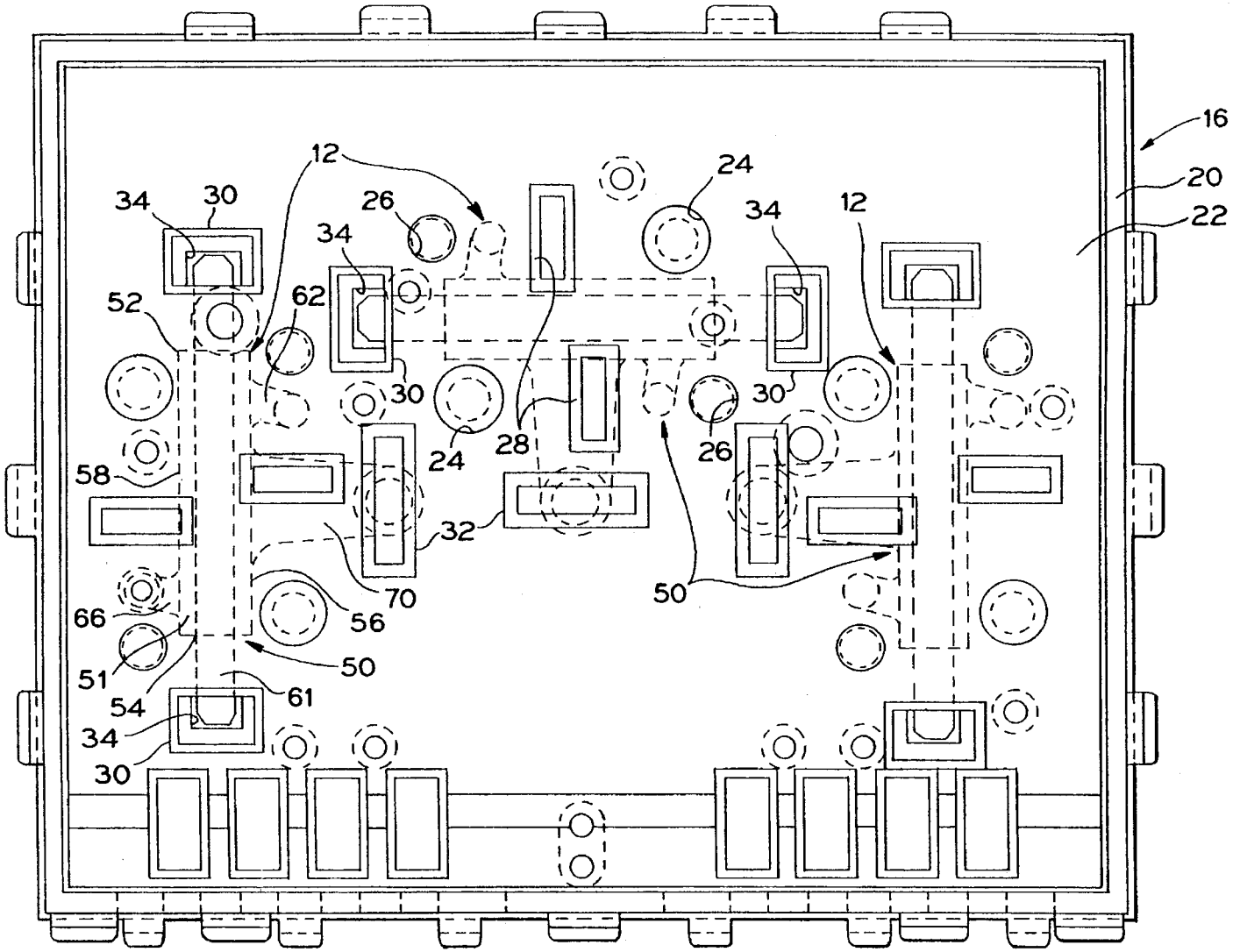
FIG. 3 is a top view of the switch assembly with the top cover, button, and all pivot point wiping contact assemblies removed.

Turning to FIG. 3, the base 16 of the control assembly has an outer wall 20 and a floor 22. Referring to the center actuator assembly in FIG. 3, it can be seen that the floor 22 provides two battery rivet holes 24, two ground rivet holes 26, two grooves 28, a pair of guide pin mounts 30, and an actuator center extension support 32. The actuator center extension support 32 and the guide pin mounts 30 extend upward from the floor 22. Furthermore, on the top of each of the guide pin mounts 30 there is a clevis 34 with the open end of each clevis facing the other.

Figure 4:
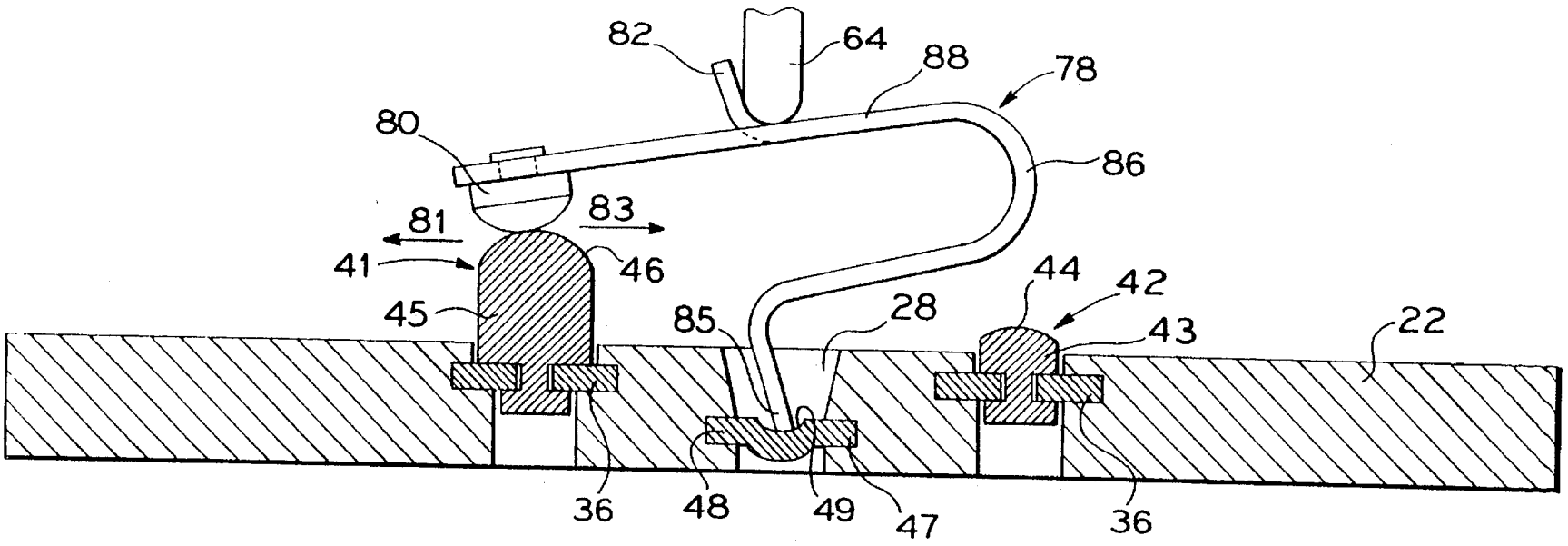
FIG. 4 is an enlarged cross-sectional side view of a pivot point wiping contact assembly in the closed position.

As shown in FIG. 1, 2, 4, and 5, molded within the top of the floor 22 is a signal insert 36. The signal insert 36 provides electrical conductive paths both to and from a contact assembly. Referring to the center contact assembly in FIG. 2, the signal insert 36 provides two battery rivet mounting pin holes 38 and two ground rivets mounting pin holes 40. Riveted onto each battery rivet mounting pin hole 38 is a battery rivet 41. Likewise, riveted onto each ground rivet mounting pin hole 40 is a ground rivet 42. As shown in FIG. 4, the ground rivet 42 has a body portion 43 with a mating surface 44. Similarly, the battery rivet 41 has a body portion 45 and a mating surface 46, both the body portion and the mating surface are larger than that of the ground rivet 42.

Figure 5:
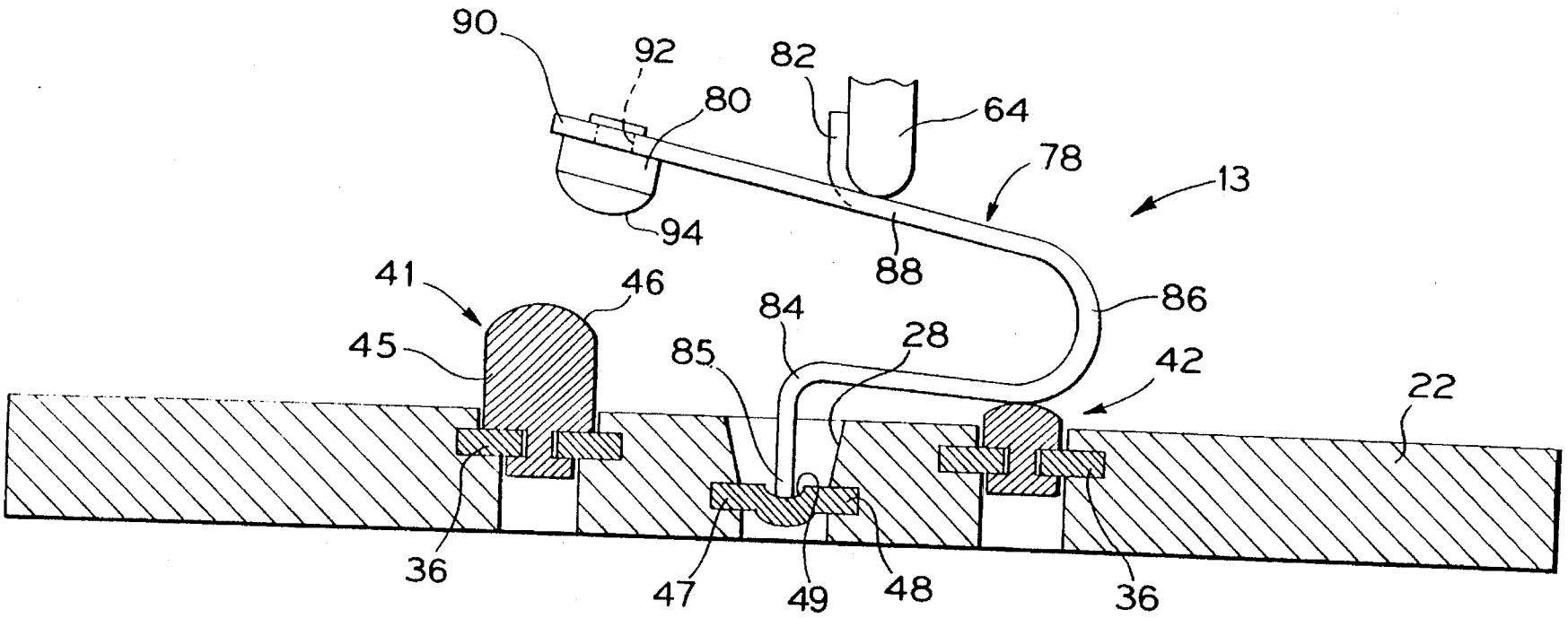
FIG. 5 is an enlarged cross-sectional side view of a pivot point wiping contact assembly in the open position.

Also, as depicted in FIG. 1, 2, 4 and 5, molded within the bottom of the floor 22 is a pocket insert 47. The pocket insert 47 provides electrical conductive paths to and from a contact assembly. For instance, in FIG. 2, two electrical conductive paths are provided to the center contact assembly by the pocket insert 47 via two pocket contacts 48. As shown in FIG. 4 and 5, each of the pocket contacts 48 occupies the grooves 28 in the floor 22 and has a slot 49.

As shown in FIG. 3, each contact assembly 12 also has an associated actuator assembly 50. Referring to the left contact assembly depicted in FIG. 3, the actuator assembly 50 has an actuator 51 which is generally cylindrical in shape with a first end 52, a second end 54, a first side 56, a second side 58, and a bore 60 (See FIG. 2 for a depiction of the bore).

The actuator 51 is slidably mounted using a guide pin 61. The guide pin 61 fits within the bore of the actuator 51 and extends past both the first end 52 and second end 54 of the actuator. Each end of the guide pin 61 is mounted within the clevis 34 of each guide pin mount 30.

Fixed on the first side 56 and adjacent to the first end 52 of the actuator 51 is a first arm 62. The first arm 62 extends from the actuator 51 in a generally perpendicular manner with a slight angle toward the second end 54. Also, as illustrated in FIG. 2, fixed on the end of the first arm is a first pin 64. The first pin 64 is generally cylindrical in shape, extends downward from the first arm, and has a rounded tip.

Correspondingly, referring back to FIG. 3, located on the second side 58 and adjacent to the second end 54, is a second arm 66. The second arm 66 extends from the actuator 51 in a generally perpendicular manner with a slight angle toward the first end 52. Also, as illustrated in FIG. 2, located on the end of the second arm is a second pin 68. The second pin 68 is generally cylindrical in shape, extends downward from the second arm 66, and has a rounded tip.

As shown on the left contact assembly 12 of FIG. 3, set on the first side 56 of the actuator 51, and between the first end 52 and the second end 54, is a center extension 70. The center extension 70 extends from the actuator 51 in a perpendicular manner to the top of the actuator center extension support 32. As best shown in FIG. 2, on the end of the center extension 70 is a center pin 72. The center pin 72 is generally cylindrical in shape, extends upwardly from the center extension 70, and has a groove 74 adjacent to its tip.

Turning to FIG. 5, in making an electrical connection between a pocket contact 48 and either a battery rivet 41 or a ground rivet 42, a pivot point wiping contact assembly 13 is used. The pivot point wiping contact assembly 13 consists of a wiping arm 78, a contact rivet 80, and a contact driver 82. The wiping arm 78 consists of a resilient conductive material having an L-shaped portion 84 with a first end 85, a U-shaped portion 86, and an arm 88 with a second end 90. The first end 85 of the L-shaped portion 84 is pivotally mounted within the slot 49 of the pocket contact 48. Also located on the arm 88 of the wiping arm 78 is the contact driver 82. The contact driver 82 extends generally perpendicular to the arm 88 and abuts a corresponding pin from the actuator such as the first pin 64. Furthermore, near the second end 90 of the arm 88 is a contact rivet mounting hole 92. The contact rivet 80 is riveted onto the arm 88 via the contact mounting hole 92. The contact rivet 80 has a mating surface 94 which is larger than that of the ground rivet 42 but less than that of the battery rivet 41.

As shown in FIG. 1, mounted on the center pins 72 of the actuators 51 is a button 96. Referring to the center actuator, when the button 96 is forcibly slid to the left, the actuator will slide to the left. As the actuator moves, the first pin 64 of the actuator will push against the contact driver 82 of the pivot point wiping contact assembly 13. Turning to FIG. 5, as the first pin 64 moves to the left, the first end 85 of the contact L-shaped portion 84 will pivot in the slot 49 of the pocket contact 48 as the wiping arm 78, most notably in the area of the U-shaped portion 86, becomes compressed. Once the first end 85 has pivoted in the slot 49, the mating surface 94 of the contact rivet 80 will unite with the mating surface 46 of the battery rivet 41. Furthermore, as the first pin 64 progresses to the left, the mating surface 94 of the contact rivet 80 will forcibly slide over the mating surface 46 of the battery rivet 41 until the contact rivet obtains the position as shown in FIG. 4. The sliding action of the contact rivet 80 over the mating surface 46 of the battery rivet 41, in the direction of arrow 81, will result in the removal of debris from both mating surfaces so that a reliable electrical connection will be made. In the preferred embodiment, 0.150" of actuator travel will result in 0.045" of scrubbing action between the contact rivet 80 and the battery rivet 41 surfaces.

Conversely, when no lateral force is applied to the button, the wiping arm 78 will return to its initial position (i.e., the position shown in FIG. 5) as the U-shaped portion 86 releases from its compressed state. As the wiping arm 78 returns to its initial position, the actuator and the button will slide to the right due to the force of the contact driver on the first pin 64. Thus, as depicted in FIG. 4, the wiping arm 78 will move to the right as it returns to its initial position. The movement of the wiping arm will cause the first end 85 of the wiping arm 78 to pivot in the slot 49 of the pocket contact 48. The pivoting of the wiping arm 78 will cause the mating surface 94 of the contact rivet 80 to forcibly slide over the mating surface 46 of the battery rivet 41, in the direction of arrow 83, until the contact rivet mating surface finally separates from the mating surface of the battery rivet 41. The sliding action of the contact rivet 80 over the mating surface 46 of the battery rivet 41 will result in the removal of any debris from both mating surfaces so that a reliable electrical connection can be made whenever the surfaces are later to be reunited. The wiping arm 78 will regain its initial position as shown in FIG. 5. Furthermore, the wiping arm 78 will form an electrical connection with the ground rivet 42.

Although only the operation of one of the pivot point wiping contact assemblies was described above, it should be noted that connected to each actuator assembly are two pivot point wiping contact assemblies which operate inversely to each other. For example, as one actuator assembly pivot point wiping contact is in the process of making a connection between the battery rivet and the contact rivet, the other pivot point wiping contact will be in the process of connecting to its associated ground rivet.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. An electrical switch comprising:

a) a battery rivet mounted on a floor of said switch and having a mating surface positioned above an upper surface of said floor;

b) a contact rivet having a mating surface;

c) means for sliding said mating surface of said contact rivet on and off of said mating surface of said battery rivet, said sliding means comprising:

i) a resilient wiping arm having a first end, said contact rivet mounted onto said wiping arm;

ii) means for moving said wiping arm about said battery rivet mating surface; and iii) a pocket contact positioned within a groove in said floor and thereby entirely disposed below said upper surface of said floor, said pocket contact having a slot and said first end of said wiping arm pivotally mounted within said slot.

2. The electrical switch of claim 1, which further comprises:

a) a contact driver mounted to said wiping arm; and b) a first pin abutting said contact driver for moving said wiping arm.

3. The electrical switch of claim 1, wherein said wiping arm consists of conductive material.

4. The electrical switch of claim 1, wherein said pocket contact consists of conductive material.

5. The electrical switch of claim 1, wherein said mating surfaces are convex.

6. An electrical switch comprising:

a) a battery rivet mounted on a floor of said switch and having a convex mating surface positioned above an upper surface of said floor;

b) a contact rivet having a convex mating surface;

c) a resilient wiping arm consisting of conductive material and having a first end, said contact rivet mounted to said wiping arm;

d) a pocket contact positioned within a groove in said floor and thereby entirely disposed below said upper surface of said floor, said pocket contact consisting of conductive material and having a slot, said first end of said wiping arm pivotally mounted within said slot;

e) a contact driver mounted to said wiping arm;

f) a first pin abutting said contact driver for moving said wiping arm in order to scrub said mating surface of said battery rivet with said mating surface of said contact rivet; and wherein an electrically conductive path is maintained between said pocket contact and said first end of said resilient wiping arm.

7. An electrical switch comprising:

a) a first battery rivet and contact rivet pair, said first battery rivet mounted on a floor of said switch and having a mating surface positioned above an upper surface of said floor and said first contact rivet having a mating surface;

b) a second battery rivet and contact rivet pair, said second battery rivet mounted on said floor of said switch and having a mating surface positioned above said upper surface of said floor and said second contact rivet having a mating surface;

c) means for selectively connecting said mating surfaces of one of said first and said second battery rivet and contact rivet pair together by sliding said mating surface of said contact on said mating surface of said battery rivet, said connecting means comprising:

i) a first resilient wiping arm having a first end, said first contact rivet connected to said wiping arm;

ii) a second resilient wiping arm having a first end, said second contact rivet connected to said wiping arm; and iii) means for moving one of said first wiping arm and said second wiping arm about a selected said battery rivet;

d) a first pocket contact positioned within a groove in said floor and thereby entirely disposed below said upper surface of said floor, said first pocket contact having a first slot and said first end of said first wiping arm being pivotally mounted within said first slot; and e) a second pocket contact positioned within a groove in said floor and thereby entirely disposed below said upper surface of said floor, said second pocket contact having a second slot and said first end of said second wiping arm being pivotally mounted within said second slot.

8. The electrical switch of claim 1, which further comprises:

a) a first contact driver mounted onto said first wiping arm;

b) a first pin abutting said first contact driver for moving said first contact;

c) a second contact driver mounted onto said second wiping arm; and d) a second pin abutting said second contact driver for moving said second contact.

9. The electrical switch of claim 8, which further comprises:

a) a single actuator attached to both said first pin and said second pin.

10. The electrical switch of claim 7, wherein said first wiping arm and said second wiping arm consists of conductive material.

11. The electrical switch of claim 7, wherein said first pocket contact and said second pocket contact consists of conductive material.

12. The electrical switch of claim 7, wherein both of said mating surfaces to said first battery rivet and contact rivet pair and both of said mating surface to said second battery rivet and contact rivet are convex.

13. An electrical switch comprising:

a) a first battery rivet and contact rivet pair, said first battery rivet mounted on a floor of said switch and having a convex mating surface positioned above an upper surface of said floor and said first contact rivet having a convex mating surface;

b) a second battery rivet and contact rivet pair, said second battery rivet mounted on said floor of said switch and having a convex mating surface positioned above said upper surface of said floor and said second contact rivet having a convex mating surface;

c) a first resilient wiping arm consisting of conductive material and having a first end, said first contact rivet mounted to said first wiping arm;

d) a second resilient wiping arm consisting of conductive material and having a first end, said second contact rivet mounted to said second wiping arm;

e) a first pocket contact positioned within a groove in said floor and thereby entirely disposed below said upper surface of said floor wherein said first pocket contact is made of conductive material and having a slot, said first end of said first wiping arm being pivotally mounted within said first slot;

f) a second pocket contact positioned within a groove in said floor and thereby entirely disposed below said upper surface of said floor wherein said second pocket contact is made of conductive material and having a slot, said first end of said second wiping arm being pivotally mounted with said second slot;

g) a first contact driver mounted onto said first wiping arm;

h) a first pin abutting said first contact driver;

i) a second contact driver mounted onto said second wiping arm;

j) a second pin abutting said second contact driver; and k) an actuator attached to said first pin and said second pin.

14. An apparatus for electrically connecting a battery rivet having a mating surface to a contact rivet having a mating surface, said apparatus comprising:

a) a contact rivet having a mating surface;

b) a floor adapted to support the battery rivet such that the battery mating surface is positioned above an upper surface of said floor;

c) an actuator having movement along an axis;

d) a pivot point wiping contact assembly comprising a resilient wiping arm supporting said contact rivet and having a first end, and a contact driver;

e) a pocket contact positioned within a groove in said floor and thereby entirely disposed below said upper surface of said floor wherein said first end is pivotally connected to a slot in said pocket contact;

f) means connected to said actuator for moving said contact rivet mating surface along said axis for making electrical connection with the battery rivet mating surface; and wherein an electrically conductive path is maintained between said pocket contact and said first end of said resilient wiping arm.

15. The apparatus of claim 14, wherein said moving means comprises a pin connected to said actuator and abutting said contact driver.

* * * * *